United States Patent [19]

Pavék

[11] Patent Number: 4,498,279

[45] Date of Patent: Feb. 12, 1985

[54] METHOD OF AND APPARATUS FOR SPLICING FIBER FORMATIONS

[75] Inventor: Miloslav Pavék, Liberec, Czechoslovakia

[73] Assignee: Elitex, koncern textilniho strojirenstvi, Liberec, Czechoslovakia

[21] Appl. No.: 569,391

[22] Filed: Jan. 9, 1984

[30] Foreign Application Priority Data

Jan. 7, 1983 [CS] Czechoslovakia ..... 126-83

[51] Int. Cl.[3] ..... D01H 15/00

[52] U.S. Cl. ..... 57/22

[58] Field of Search ..... 57/22, 23, 261, 350, 57/351, 908

[56] References Cited

U.S. PATENT DOCUMENTS 4,419,859 12/1983 Mima ..... 57/22
4,432,194 2/1984 Luz ..... 57/22
4,452,035 6/1984 Rohner et al. ..... 57/22

FOREIGN PATENT DOCUMENTS 145075 11/1981 Japan ..... 57/22
956992 4/1964 United Kingdom ..... 57/22

*Primary Examiner*—Donald Watkins

[57] ABSTRACT

Method of and apparatus for splicing fibrous formations, particularly yarns. Mutually closely arranged parallel and overlapping ends of the fibrous formations to be spliced are disposed inside the pressure channel of a splicing chamber. The thus disposed fibrous formations are subjected to the whirling action of pressure air and at least at one of the mouth of said pressure channel they are subjected to the action of an air flow from the pressure channel, such air flow vibrating at a high frequency. Such vibration of the air flow is achieved by directing the air flow column from the pressure channel toward an obstacle confronting and near the mouth of the pressure channel. Such obstacle may be made adjustable, whereby to adjust the frequency of vibration of the air flow column.

10 Claims, 4 Drawing Figures

METHOD OF AND APPARATUS FOR SPLICING FIBER FORMATIONS

This application is related to that of PAVEK et al, Ser. No. 569,392, filed Jan. 9, 1984.

The present invention relates to a method of and an apparatus for splicing fiber formations. Typical of such formations are yarns which have been or are to be processed in textile machines. The splicing takes place in a pressure channel of a splicing chamber, in which the ends of the fibrous formations to be spliced are arranged beside each other in overlapping relationship, and are then subjected to the whirling effect of pressure air fed to the pressure channel.

The disadvantages of the methods of pneumatic splicing of fibrous formations hitherto used are the low strength of the connection, particularly in the longitudinal direction of the fibrous formations, as well as the lack of reliability of the actual technological procedure of splicing.

These disadvantages are caused by an insufficient mutual set of the fibers of the fiber formation ends to be spliced. For the purpose of preventing such condition, the known devices have been operated under increased pressure of the air fed thereto, and such feeding of air had taken place for a relatively long time. This, however, entails a lower efficiency of use of the pressure air. Furthermore, lower strength and lower reliability of the spliced connection of the fibrous formation ends are substantially caused by a low adaptability of the apparatus used with different fibrous formations. Thus certain splicing methods are intended only for certain materials, i.e. of one twist direction, a certain number, and a certain staple length of the separated fibers. Therefore these methods cannot always be reliably used upon changing the type of fibrous formations to be spliced.

Thus, in accordance with the prior art, the pneumatic elements must be adapted in their dimensions in the known splicing devices to the selected type of fibrous formations being spliced, and to make the effectiveness of certain of them more acceptable, the cycle of operation must be divided into several time invervals. As a result, the apparatus used becomes excessively intricate, very critical as to its adjustment, and expensive.

The splicing of fibrous formations by means of air pressure involves a certain risk, which is that the ends of the fibrous formation to be spliced may be blown out of the pressure channel before being spliced. This is prevented by using various additional devices, which retain the cut ends of the fibrous formations in various manners. This increases the intricacy of the aparatus employed, and the rate of failure of the spliced fibrous formations.

The above outlined disadvantages of the methods of splicing fibrous formations hitherto known are mitigated to a great extent by the method of splicing fibrous formations according to the present invention. In accordance with such method, the fibrous formations are subjected, at least at one mouth of the pressure channel, to an air flow from the pressure channel, such air flow oscillating or vibrating at a high frequency within either the audible range of a sonic wave or the supersonic, inaudible range of such wave.

From the viewpoint of the intended length of the spliced connection, as well as the quality and type of fibrous material being spliced, it is advantageous in accordance with the present invention to adjust the frequency of oscillation of air flow by changing the length of the column of the air flow from the pressure channel by its being directed toward a displaceable obstacle near the mouth of the pressure channel.

It is further advantageous, according to the present invention, for the purpose of preventing an undesired blowing out of the fibrous formation ends from the pressure channel before their mutual splicing, to deflect the fibrous formations from the longitudinal axis of at least one mouth of the pressure channel before the splicing of the formations.

The effects of the method for splicing fibrous formations according to the present invention are particularly evident in that the pressure air power is employed with a high efficiency, that various types of fibrous formations can be spliced without disturbing the condition of parallel arrangement of the fibers in the connection to be spliced, and without performing any substantial adjusting operations on the splicing chamber. It is also advantageous that in the spliced connection the inner structure of the fibrous formations are not disturbed at any location other than at the spliced connection.

For performing the method according to the present invention, an apparatus is particularly suitable in which at least one of the mouths of the pressure channel in the splicing chamber has a displaceable obstacle with a blade, such blade engaging the air flow from the pressure channel, the arrangement of said obstacle or obstacles being advantageously bilaterally symmetrical relative to the pressure channel.

Various modifications of the splicing chamber of the invention may be made while maintaining the above-described basic construction, such modifications continuing to be characterized by their simplicity and, simultaneously, their great versatility for the treatment of various types of fibrous formations to be spliced. Thus, e.g. the blades of the displaceable obstacles can be made of elastic diaphragms, they can be tuned to a selected resonant frequency, and they do not require further attendant mechanisms. Mainly, they do not prolong the length of the spliced interconnection between fiber formations, since their effects permit in turn a shortening of the length of the pressure channel in the splicing chamber.

Further advantages and effects of the present invention will become obvious from the following specification of the method and apparatus of the invention, as well as the accompanying drawings, in which.

Figure 1:
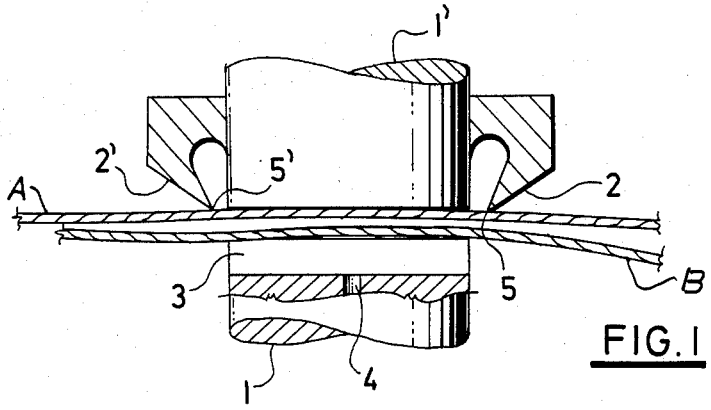
FIG. 1 is a view in longitudinal section of the splicing chamber in open condition, of the apparatus of the invention, the figure showing two fiber formations to be spliced lying within the pressure channel in side-by-side relationship.
Figure 2:
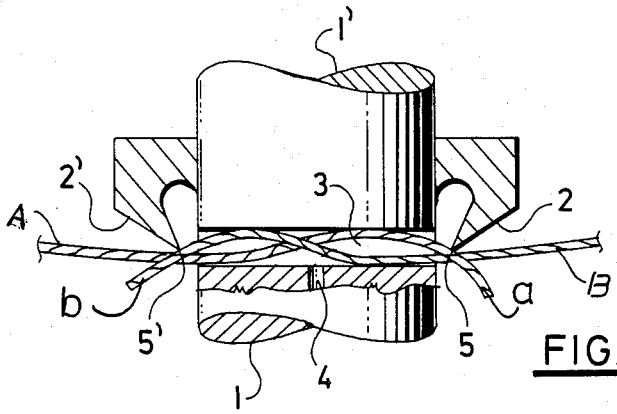
FIG. 2 is a view of the splicing chamber of FIG. 1 after the chamber has been closed, the now cut free ends of the fiber formations in the pressure channel being deflected from the longitudinal axis thereof by pressure air introduced centrally into the pressure channel and flowing out in opposite directions through the opposite ends thereof.
Figure 3:
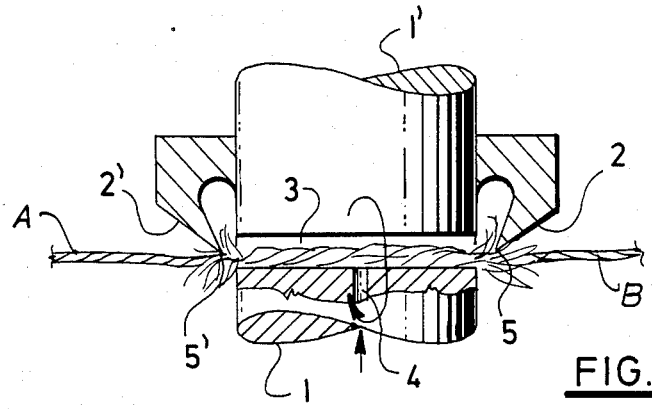
FIG. 3 is a schematic view of the apparatus in the condition thereof shown in FIG. 2, but further showing the action of the pressure air on the fiber formations.
Figure 4:
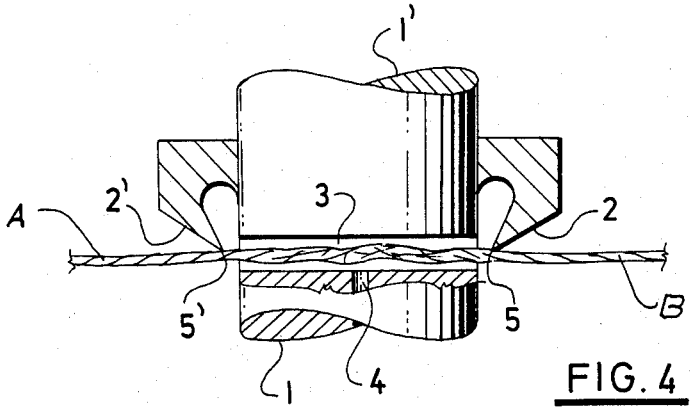
FIG. 4 is a view of the apparatus in its closed condition, the fiber formations therewithin now being in a spliced condition after finishing the introduction of the pressure air into the splicing channel.

Turning first to FIG. 1, which shows the splicing apparatus in its open position, such apparatus has a splicing chamber 1 which is provided with a cover 1'. The chamber 1 is provided with a central port 4 through which pressure air is introduced into the pressure channel 3. Fibrous formations A and B are shown as having been introduced into the pressure channel 3, such formations lying side-by-side and generally parallel to each other. The pressure channel 3 is now closed by lowering the cover 1', whereupon a cutting device or cutting devices (not shown) cuts or cut off, or possibly shorten the ends of the fibrous formations A and B to form the respective ends a, b of suitable length, as shown in FIG. 2. The cutting device or devices may be similar to those illustrated and described in the above referred to Pavek et al application.

Mounted upon the lid 1' are obstacles 2, 2' disposed at the respective ends of the pressure channel 3, obstacles 2, 2' bearing respective blades 5, 5' which, when lid 1' is lowered as shown in FIG. 2, partially overlie the mouths or outer ends of the pressure channel 3. Blades 5, 5' of the lowered lid deflect at least the ends a, b of fibrous formations A, B from the longitudinal axis of the pressure channel 3, thus preventing to a sufficient extent the blowing out of said ends a, b during the further operation of the apparatus, that is, before the splicing of the fibrous formations.

Following the lowering of the lid 1', pressure air is now introduced into the pressure channel 3 through the central passage 4. Intensive whirling of the pressure air now takes place in the pressure channel 3, causing the partial untwisting of the fibers of the fibrous formations A, B, and the mutual penetration into each of such fibrous formations by the separate fibers of the opposite fibrous formation. The splicing effect of the whirling pressure air is reinforced by raising to a high frequency, within either the audible or the supersonic range of the sonic wave spectrum, of vibration of the pressure air by directing the pressure air columns leaving the mouths of the pressure channel 3 against a suitable adjustable obstacle 2, or 2', respectively, which is positioned in front of one or of both mouths of the pressure channel 3.

A highly intensive mutual splicing of the separate fibers of the fibrous formations A, B now takes place, whereby a compact, knotless interconnection between the fibrous connections is formed, such knotless interconnection having a high strength in the axial direction of the spliced fiber formations.

As soon as the pressure air flow into the pressure channel 3 stops, the splicing of the fibrous formations A, B is finished. The fiber section of formations A, B to be connected return substantially to their initial condition. The lid or cover 1' of the splicing chamber 1 is now opened, and the spliced fibrous formations A, B are removed from the opened pressure channel 3 to be subjected to further normal technological processing thereof.

For the purpose of vibrating the pressure air column, which whirls out of both ends of the pressure channel 3, the blades 5, 5' obstacles 2, 2' may be made of e.g. elastic diaphragms, or said blades 5, 5' are tuned in another manner to the pertinent resonant frequency, and the like. The frequency of vibration of the air columns can also be changed in various manners by adjusting the blades 5, 5' of obstacles 2, 2' toward or away from the respective mouths of the pressure channel 3.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. Method of splicing fibrous formations, such as yarns in the pressure channel of a splicing chamber, comprising arranging the ends of the fibrous formations to be spliced in side-by-side overlapping relationship in the pressure channel, introducing pressure air into the splicing channel so that it blows outwardly therethrough so as to subject the portions of the fibrous formations disposed within the pressure channel to the action of the air as it flows outwardly from the pressure channel, and vibrating the column of air passing through the pressure channel at a high frequency lying within the frequency range from the high frequency end of the audible to a supersonic frequency within the sonic wave spectrum.

2. A method as claimed in claim 1, wherein pressure air is fed into the longitudinal center of the pressure channel whereby air columns are formed which flow in opposite directions in the pressure channel; outwardly through the respective mouths of the pressure channel, and vibrating both of such air columns at a high frequency lying within the frequency range from the high frequency end of the audible to a supersonic frequency within the sonic wave spectrum.

3. A method as claimed in claim 1, comprising adjusting the frequency of vibration of the air flow emerging from the pressure channel in accordance with the intended length of the spliced connection and the properties of the fibrous material.

4. Method as claimed in claim 2, wherein the frequency of vibration of the air flow emerging from the pressure channel is adjusted by changing the length of the air flow column from the pressure channel by directing it toward an adjustable obstacle spaced from the mouth of said pressure channel.

5. Method as claimed in claim 1, wherein the fibrous formations before their mutual splicing are deflected from the longitudinal axis of the pressure channel at at least one mouth thereof.

6. Apparatus for splicing fibrous formations, particularly yarns, comprising a splicing chamber having a pressure channel in which fiber formations to be spliced are disposed in side-by-side overlapping relationship, means for introducing pressure air into the splicing channel centrally thereof, and comprising an adjustable obstacle mounted before and spaced from at least one end of the mouth of the pressure channel, said adjustable obstacle being provided with a blade which engages the air flow emerging from the said mouth of the pressure channel.

7. Apparatus as claimed in claim 6, wherein the said obstacle is bilateral, so that portions thereof overlie the two opposite mouths of the pressure channel.

8. Apparatus as claimed in claim 6, wherein the splicing apparatus has a chamber and a removable cover for the chamber, and the adjustable obstacle is arranged on one side of the cover of the apparatus.

9. Apparatus as claimed in claim 6, wherein the blade of the adjustable obstacle is an elastic diaphragm.

10. An apparatus as claimed in claim 6, wherein the obstacle provided with a blade is tuned to the appurtenant resonant frequency of vibration of the column of air issuing from the respective mouth of the pressure channel.

* * * * *